US007090212B2

(12) United States Patent
Hediger

(10) Patent No.: US 7,090,212 B2
(45) Date of Patent: Aug. 15, 2006

(54) APPARATUS FOR PRODUCING A BOUND PRINT ITEM

(75) Inventor: Hanspeter Hediger, Sempach Stadt (CH)

(73) Assignee: Müller Martini Holding AG, Hergiswil (CH)

( * ) Notice: Subject to any disclaimer, the term of this patent is extended or adjusted under 35 U.S.C. 154(b) by 434 days.

(21) Appl. No.: 10/720,379

(22) Filed: Nov. 25, 2003

(65) Prior Publication Data

US 2004/0113347 A1 Jun. 17, 2004

(30) Foreign Application Priority Data

Nov. 29, 2002 (EP) ..... 02406039

(51) Int. Cl.
*B42C 19/08* (2006.01)

(52) U.S. Cl. ..... 270/52.26; 270/52.29; 198/644

(58) Field of Classification Search ..... 270/52.18, 270/52.26, 52.29; 271/69, 306, 307, 311, 271/312, 313, 189; 198/644, 478.1, 479.1, 198/600

See application file for complete search history.

(56) References Cited

U.S. PATENT DOCUMENTS

| | | | | |
|---|---|---|---|---|
| 1,348,850 | A * | 8/1920 | Christensen | 227/103 |
| 1,601,802 | A | 10/1926 | Kast | |
| 5,052,542 | A * | 10/1991 | Wipf | 198/370.08 |
| 5,375,824 | A * | 12/1994 | Anker et al. | 270/52.29 |
| 6,270,068 | B1 | 8/2001 | Cracknell | |
| 6,540,066 | B1 * | 4/2003 | Von Aesch | 198/644 |

* cited by examiner

*Primary Examiner*—Patrick Mackey
(74) *Attorney, Agent, or Firm*—Venable LLP; Robert Kinberg

(57) ABSTRACT

An apparatus for producing a bound print item from unbound printed products supplied in a straddling position to be stitched with wire staples comprises a conveying device with a support that is slanted toward the side and consists of individual elements. The conveying device includes carriers for the synchronized transfer of the printed products to an intermediate conveyor that is installed upstream of a stitching section. The transfer region between the conveying device and the intermediate conveyor is provided with a side-mounted, synchronously operated support plate which has a recess along the circumference to which the carriers are allocated.

11 Claims, 2 Drawing Sheets

APPARATUS FOR PRODUCING A BOUND PRINT ITEM

CROSS-REFERENCE TO RELATED APPLICATION

This application claims the priority of European Priority Application No 02406039.4-2304, filed on Nov. 29, 2002, the disclosure of which is incorporated herein by reference.

BACKGROUND OF THE INVENTION

The present invention relates to an apparatus for producing a bound print item from at least one printed product that is supplied in a straddling position, to be stitched with the aid of wire staples, wherein the apparatus comprises a conveying device with a support that consists of individual elements and is slanted toward the side, as well as carriers for the timed transfer of the printed products to an intermediate conveyor that is installed upstream of a wire-stitching section.

Apparatuses of this type are known from gathering and wire-stitching systems and are used to produce wire-stitched print items. The printed products are gathered with the aid of feeders, disposed along a single-belt or dual-belt conveying device, and are transported in a straddling position, one above the other, with the aid of carriers. Before the printed products reach a wire-stitching line, formed with the aid of a double circulating traction element, such as chains or belts, they are guided over a stationary guide rail. This guide rail has a section that is inclined toward the front end. However, a gap in the transition in the conveying direction is unavoidable. The conveying device end that moves downward at a slant in the transition region forms a slight bend together with the guide rail, which can change the trajectory of the transported printed products. In particular, shorter printed products will hit the guide rail and/or get stuck thereon, thus causing interruptions in the production because they cannot be picked up by the intermediate conveyor that operates jointly with the guide rail.

SUMMARY OF THE INVENTION

It is an object of the present invention to design an apparatus of the aforementioned type in so that a reliable transport of the printed products from the conveying device to the wire-stitching unit is ensured.

The above and other objects are achieved according to the invention by the provision of an apparatus for producing a bound print item from at least one printed product supplied in a straddling position to be stitched with the aid of a wire staple in a stitching section, comprising: a conveying device including a support comprised of individual elements and having a slanted side, and carriers for arranged for a synchronized transfer of the printed products to an intermediate conveyor installed upstream of the stitching section; and a synchronously driven support plate mounted to a side of the conveying device and having a circumference with at least one recess arranged for cooperating with the carriers.

As a result of the invention, the printed products that arrive at the end of the conveying device in a straddling position can be transferred without interruption to the intermediate conveyor, wherein the recess reaches the transition region at the same time as the carrier which is then received in the recess.

The circumferential speed of the support plate can equal to the conveying speed if two recesses are provided.

The at least approximately flat surface of the support plate is advantageously arranged directly above the support on the conveying device that is slanted downward on the side.

The support plate is preferably driven with the aid of a gear arrangement that is connected to the wheel for deflecting the conveying device and which transfers the machine timing to the support plate. Of course, the support plate could also be driven with the aid of a separate, torque-controlled electric motor.

The gear arrangement may comprise two operationally-connected toothed belt drive gears. The support plate is mounted to a hub, connected to the gearing, in such a way that it can be detached again for dismantling.

The support plate circumference, which provides the effective support, advantageously forms an approximately tangential connection to the line along which the printed products are guided on the support and the guide rail for the intermediate conveyor.

To increase the reliability of the apparatus, two support plates are advantageously provided which are arranged opposite each other on both sides of the conveying device.

The invention is explained further in the following with the aid of an exemplary embodiment and by referring to the drawing to which reference is made for all details not mentioned further in the specification.

DETAILED DESCRIPTION OF THE INVENTION

Figure 1:
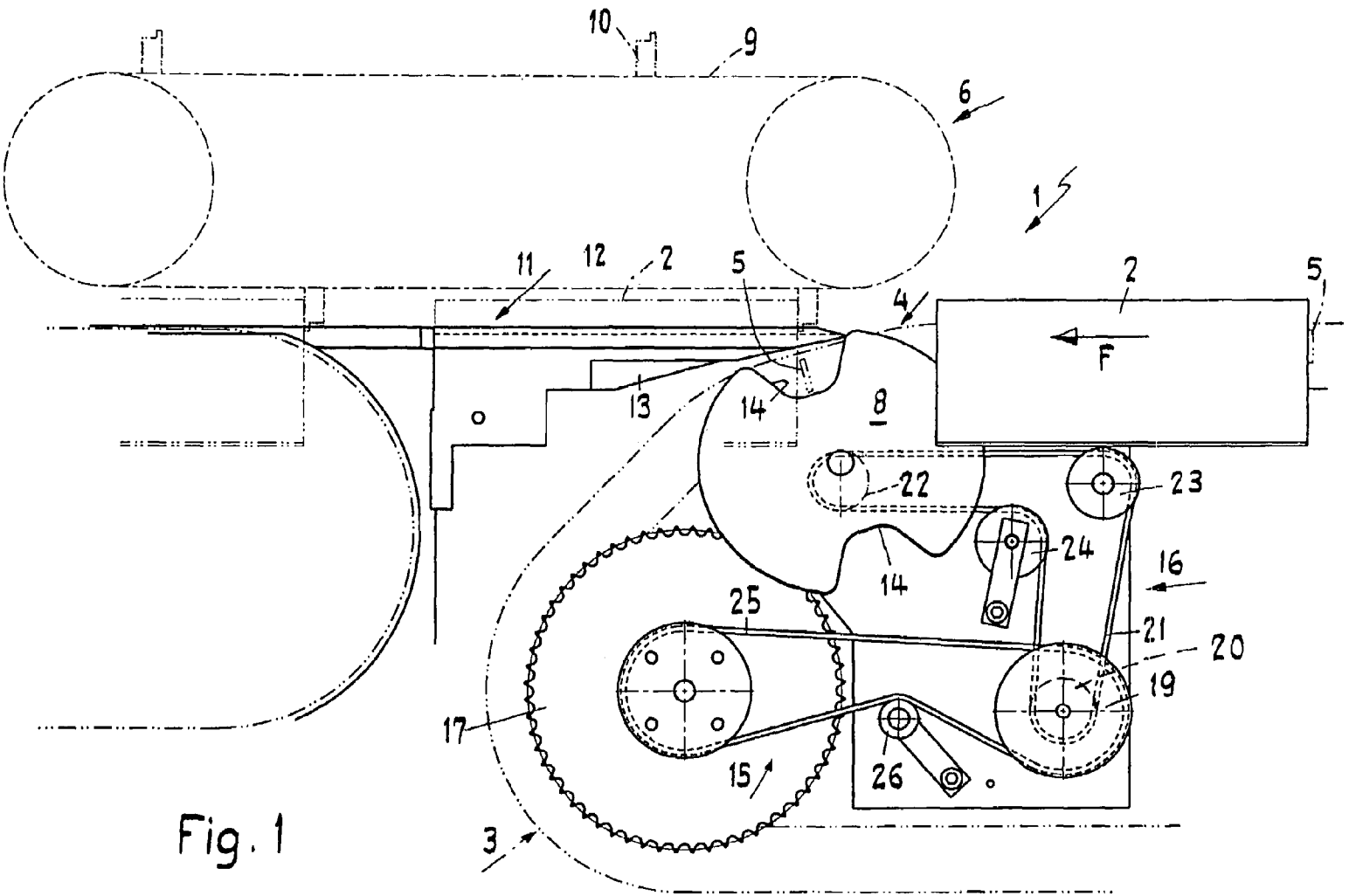
FIG. 1 a view from the side of the apparatus according to the invention.
Figure 2:
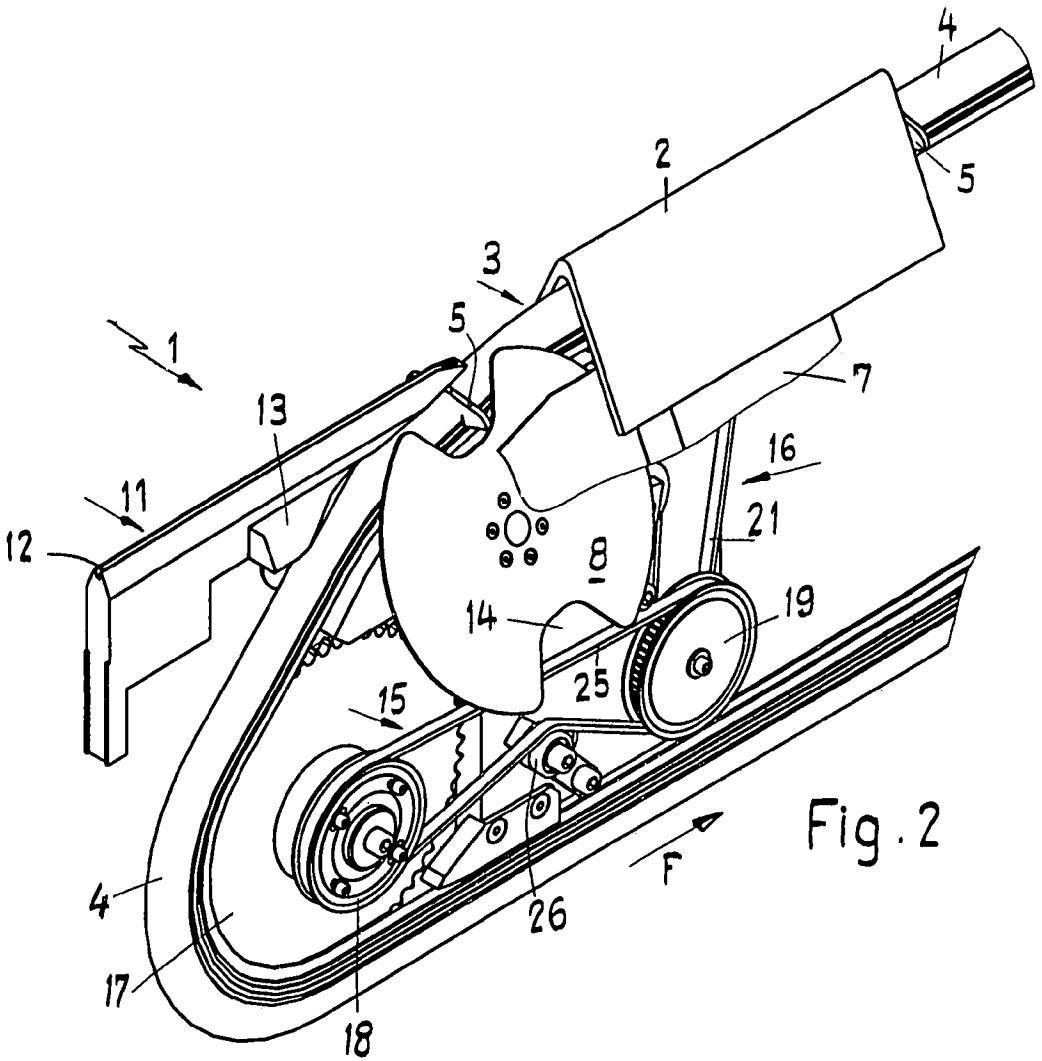
FIG. 2 a perspective representation showing the apparatus according to the invention.

FIGS. 1 and 2 show an apparatus 1 for producing a bound print item 2 that is composed of one or several folded printed products. The printed products in the form of the unbound print items 2 reach the conveying end of a conveying device 3, which consists of circulating individual parts that form a saddle-type support 4. The printed products, which rest evenly spaced apart on the support 4, are held in place on the back edge by carriers 5, to prevent displacement in the longitudinal direction on the conveying device 3. The individual parts, attached to an endless traction element, form a support 4 that is slanted downward on the side, on which the printed products are positioned straddling with spread-apart sides.

Along the conveying path to a downstream-installed intermediate conveyor 6, the unbound print item 2 is lifted up with the aid of a guiding device 7 from the surface of the support 4 on the side and is guided across a driven support plate 8 which accompanies the print item 2 in the transition region between the conveying device 3 and the intermediate conveyor 6. The print item 2 is transported with the aid of the carrier 5 into the conveying region of the intermediate conveyor 6 before the carrier leaves the path for the print item 2 in a downward direction, following the further course of the conveying device 3.

The intermediate conveyor 6, consisting of a circulating conveying fork 10 that is attached to the traction element 9, grips the rear edge of the print item 2 that arrives via the support plate 8 and conveys these on a guide rail 11 to a wire-stitching station which is not shown herein.

The conveying forks 10 are guided inside a guide groove 12 on the top of the guide rail 11. In the same way as for the support 4, the upper end guide rail 11 is provided with support surfaces that are slanted toward the side.

On the further path toward the transition region, the print item 2 is spread out further with the aid of expanding wedges 13, arranged on both sides of the guide rail 11, so as to prevent an undesirable deformation of the print item 2 at the back end by the carrier 5 of the conveying device 3 and the conveying forks 10 of the intermediate conveyor 6 during the takeover.

The height difference between the support 4 and the surface of the support plate 8, which is preferably flat and smooth, is insignificant because the support plate has a minimum thickness and a rigid design.

The support plate 8 is provided along the circumference with two oppositely arranged recesses 14 into which respectively one carrier 5 of the conveying device 3 is fitted. That is to say, the spacing of the recesses along the circumference of the support plate 8 corresponds to the distance between two carriers 5 of the conveying device 3. Since the circumferential speed of the support plate 8 at least approximately corresponds to the speed of the print items 2 on the conveying device 3, the support plate 8 is effective between two carriers 5 on the conveying device. If the support plate 8 is provided with only one recess 14, it must have twice the speed of the carriers 5. However, that is not a problem because the circumference of the support plate 8 does not function to convey, but only to support or guide.

FIG. 2 shows that the support plate 8 can be attached to a hub and the recesses 14 can have a different form from the one shown herein because of differences in the carriers 5. Of course, the support plate 8 can also be driven via a separate, torque-controlled electric motor (not shown herein) or, as illustrated, with two belt drive gears 15, 16. For this, a deflection wheel 17 of the conveying device 3 is provided with a belt pulley 18 of the first belt drive gear 15, for which the driven deflection roller 19 is drive-connected to a drive roller 20 of the second belt drive gear 16. The toothed belt 21 of the second belt drive gear 16, arranged at a right angle thereto, circulates around the rotational axis of the deflection roller 19 and drives a drive pulley 22 that is connected to the support plate 8. A deflection wheel 23 is provided between these on the working run of the toothed belt 21 while on the opposite side a tensioning roller 24 acts upon the toothed belt 21. The toothed belt 25 of the first belt drive gear 15 is tensioned with the aid of a tensioning roller 26.

FIG. 1 shows a print item 2, wherein the two sides of this item are lifted up by the guiding device 7 (see FIG. 2), so that the support plate 8 can be submerged up to the inside of the folding edge into the print item 2 while the item is transported by the carrier 5 to the operating range of the intermediate conveyor 6. The latter grips the print item 2 with respectively one conveying fork 10 in the region of the rear folded edge while the carrier 5 moves downward and leaves the conveying path for the print item 2. An expansion wedge 13 on the side of guide rail 11 additionally expands the sides of the print item 2 once it arrives, so that the print item 2 is transported without making contact with the carrier 5. The guiding device 7 can be a twice bent metal sheet used to form a flat step. A deformed bar can also be used for the same purpose. FIG. 1 does not show the guiding device 7 in the interest of showing the drive for the support plate 8.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for producing a bound print item from at least one printed product supplied in a straddling position to be stitched with the aid of a wire staple in a stitching section, comprising:

a conveying device including a support comprised of individual elements and having a slanted side, and carriers arranged for a synchronized transfer of the printed products to an intermediate conveyor installed upstream of the stitching section; and a synchronously driven support plate mounted to a side of the conveying device and having a circumference with at least one recess arranged for cooperating with the carriers.

2. The apparatus according to claim 1, wherein the support plate has a flat surface arranged to a side of the slanted side of the support of the conveying device.

3. The apparatus according to claim 2, further including a guiding device arranged upstream of the support plate, as seen in the conveying direction of the print item, the guiding device lifting up sides of the print item on the side of the support of the conveying device.

4. The apparatus according to claim 1, further including a deflection wheel coupled to the conveying device and a gear connected to the deflection wheel and arranged for driving the support plate.

5. The apparatus according to claim 4, wherein the gear comprises two drive-connected toothed belt drive gears.

6. The apparatus according to claim 4, including a hub connected to the gear, wherein the support plate is detachably mounted to the hub.

7. The apparatus according to claim 1, wherein the circumference of the support plate is arranged approximately tangentially to a conveying path of the print item.

8. The apparatus according to claim 1, further comprising a guide rail arranged for straddle positioning of the print item received from the conveying device, wherein the support plate has an operating surface that is arranged on a side of the guide rail.

9. The apparatus according to claim 1, further including the intermediate conveyor, wherein a guide rail is arranged in an operational range of the intermediate conveyor.

10. The apparatus according to claim 1, wherein the support plate comprises two support plates positioned opposite each other on both sides of the conveying device.

11. The apparatus according to claim 10, further including expanding wedges arranged below the intermediate conveyor.

* * * * *